US007361067B1

(12) United States Patent
Smedema

(10) Patent No.: US 7,361,067 B1
(45) Date of Patent: Apr. 22, 2008

(54) METHOD FOR CONTROLLING THE ACCELERATION OF A MARINE VESSEL USED FOR WATER SKIING

(75) Inventor: Gene A. Smedema, Brandon, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/591,807

(22) Filed: Nov. 2, 2006

(51) Int. Cl.
*B63H 21/22* (2006.01)

(52) U.S. Cl. ..... 440/1; 440/87

(58) Field of Classification Search ..... 440/1, 440/87

See application file for complete search history.

(56) References Cited

U.S. PATENT DOCUMENTS

| | | | | |
|---|---|---|---|---|
| 5,074,810 | A | 12/1991 | Hobbs et al. | 440/2 |
| 5,110,310 | A | 5/1992 | Hobbs | 440/1 |
| 5,586,535 | A | 12/1996 | Syomura | 123/352 |
| 5,700,171 | A | 12/1997 | Horton | 440/87 |
| 5,765,528 | A | 6/1998 | Kamimaru | 123/339.19 |
| 6,109,986 | A | 8/2000 | Gaynor et al. | 440/87 |
| 6,414,607 | B1 | 7/2002 | Gonring et al. | 341/20 |
| 6,485,341 | B1 | 11/2002 | Lanyi et al. | 440/87 |
| 6,672,282 | B2 | 1/2004 | Harrison et al. | 123/399 |
| 7,214,110 | B1 * | 5/2007 | Ehlers et al. | 440/1 |

OTHER PUBLICATIONS

U.S. Appl. No. 11/245,370, filed Oct. 5, 2005, Ehlers et al.

* cited by examiner

*Primary Examiner*—Stephen Avila
(74) *Attorney, Agent, or Firm*—William D. Lanyi

(57) ABSTRACT

A system is provided which stores data relating to the operation of a marine vessel during a water skier launch procedure. The data can include a plurality of throttle handle positions that are stored at a frequency which is suitable for reproducing the movement profile of the handle during a launch procedure. The water skier launch profile is then stored so that it can be recalled and reactivated to repeat the acceleration profile of the boat.

20 Claims, 5 Drawing Sheets

METHOD FOR CONTROLLING THE ACCELERATION OF A MARINE VESSEL USED FOR WATER SKIING

BACKGROUND OF THE INVENTION

1. Field of the Invention

The present invention is generally related to the control of a marine vessel and, more particularly, to the acceleration control used during the initial launch to bring a water skier from a generally stationary position to a water skiing position.

2. Description of the Related Art

Those skilled in the art of marine propulsion systems, particularly in relation to water ski boats, are familiar with various techniques and procedures used to facilitate the initiation, or launch, of a water skiing effort. In addition, those skilled in the art of marine propulsion systems are familiar with various types of engine speed control systems, including the operation of throttle handles and procedures for transmitting information relating to the position of a throttle handle to an engine control system that selects the operating speed of the engine.

U.S. Pat. No. 5,074,810, which issued to Hobbs et al. on Dec. 24, 1991, describes an automatic speed control system for boats. An apparatus for accurately maintaining the speed of a motorboat at a value set by an operator is described. The speed of the boat is measured and compared to a desired speed set by the operator and the speed of the boat engine is adjusted to minimize the difference between the desired speed and the actual speed. The device further incorporates features allowing the incremental adjustment of the desired speed, storage of several of these speeds for future use, and a safety feature causing the system to behave as though it were of a conventional manual type if the operator makes a gross change to the setting of a manual throttle lever.

U.S. Pat. No. 5,110,310, which issued to Hobbs on May 5, 1992, describes an automatic speed control system for boats. An improved apparatus for accurately maintaining the speed of a motor boat at a value set by an operator is described. Speed of the boat and force on the boat due to a water skier are measured. Actual speed is compared to a desired speed set by the operator and the speed of the boat engine is adjusted to minimize the difference between the desired speed and the actual speed. Engine speed is further adjusted to prevent or minimize changes in the speed of the boat caused by the forces on the boat due to a water skier. The device further incorporates features to induce the likelihood of speed measurement errors due to malfunctioning speed measuring devices.

U.S. Pat. No. 5,586,535, which issued to Syomura on Dec. 24, 1996, describes an engine rotational number controller. It includes an engine rotational number detector for detecting the number of rotations of an engine, a throttle opening detector for detecting a throttle opening of the engine, an ignition device, a stepping motor, an injector, and a control circuit for delaying an ignition timing of the ignition device when the number of rotations of the engine becomes higher than a predetermined upper limit in the case where the throttle number is constant and for opening a sub-throttle valve of a throttle valve by means of the stepping motor to increase an amount of intake air and to increase an amount of injected fuel in the injector when the number of rotations of the engine become lower than a predetermined lower limit in the case where the throttle opening is constant.

U.S. Pat. No. 5,700,171, which issued to Horton on Dec. 23, 1997, describes a speed control system. A speed controller for a vehicle comprises speed sensors which output to a controller which in turn outputs to a servo motor. The servo is connected to the inner cable of a coaxial cable, the outer sheath of which is lodged between a buttress and the engine throttle. The distance between the buttress and engine throttle lever is, at least when the throttle is closed, shorter than the length of the outer sheath such that the outer sheath obtains a curved configuration. The inner cable extends beyond the engine throttle lever to a support. Accordingly, when the controller operates the servo to draw in the inner cable, the outer sheath is urged to straighten and therefore push against the engine throttle lever to open it. Conversely, when the inner cable is paid out, the outer sheath is relaxed to allow the engine throttle lever to close.

U.S. Pat. No. 5,765,528, which issued to Kamimaru on Jun. 16, 1998, describes an idle speed control system for an automotive internal combustion engine. During idling of an internal combustion engine, when there is a difference between an actual engine speed and a target idle speed which is preset in accordance with an engine load, the opening and closing timings of an intake/exhaust valve of the engine is changed in accordance with the difference between the actual engine speed and the target idle speed to change an intake airflow sucked into the engine.

U.S. Pat. No. 6,109,986, which issued to Gaynor et al. on Aug. 29, 2000, discloses an idle speed control system for a marine propulsion system. The system controls the amount of fuel injected into the combustion chamber of an engine cylinder as a function of the error between a selected target speed and an actual speed. The speed can be engine speed measured in revolutions per minute or, alternatively, it can be both speeds measured in nautical miles per hour or kilometers per hour. By comparing target speed to actual speed, the control system selects an appropriate pulse width length for the injection of fuel into the combustion chamber and regulates the speed by increasing or decreasing the pulse width.

U.S. Pat. No. 6,414,607, which issued to Gonring et al. on Jul. 2, 2002, discloses a throttle position sensor with improved redundancy and high resolution. The sensor is provided with a plurality of sensing elements which allow the throttle position sensor to provide a high resolution output to measure the physical position of a manually movable member, such as a throttle handle, more accurately than would otherwise be possible. The plurality of sensors significantly increases the redundancy of the sensor and allows its operation even if one of the sensing elements is disabled.

U.S. Pat. No. 6,485,341, which issued to Lanyi et al. on Nov. 26, 2002, discloses a method for controlling the average speed of a vehicle. The average speed of a vehicle is controlled over a predetermined time period, or indefinitely, or distance length is described with reference to selecting a desired average speed, measuring an actual speed, and maintaining a cumulative error determined as a function of the difference between the average speed and actual speed and the time over which the actual speed measurement was taken. Based on the cumulative total of speed-time error, a compensatory speed is calculated that will reduce the cumulative speed-time error to an acceptable tolerance range within a selected period of elapsed time. Although particularly applicable to competition situations in which an average speed is dictated for use over a particular competition course, the average speed controlling method can be used in other situations where the average speed of a vehicle must be controlled.

U.S. Pat. No. 6,672,282, which issued to Harrison et al. on Jan. 6, 2004, describes an increased resolution electronic throttle control apparatus and method. The device is intended for controlling a throttle of an electric throttle control equipped engine including providing a throttle position feedback signal as a function of integer counts, each of the counts representing a resolution of a predetermined angle of actual throttle position, providing a desired throttle position command as a set point value being a function of half counts and generating an error signal representing a difference between the desired throttle position command value and the throttle position feedback signal value. A relay output signal is generated in response to the error signal, the relay output signal having one or two values depending upon a sign of the error signal and a direction of change of the error signal. A throttle actuator command is then generated as a function of the relay output signal value having a half count resolution.

U.S. patent application Ser. No. 11/245,370 (M09953) which was filed by Ehlers et al. on Oct. 6, 2005, discloses an acceleration control system for a marine vessel. The system is provided which allows the operator of a marine vessel to select an acceleration profile to control the engine speed of a marine vessel from an initial starting speed to a final desired speed. When used in conjunction with tow sports, such as wakeboarding and water skiing, the use of an acceleration profile provides consistent performance during the period of the time when a water skier is accelerated from a stationary position to a full speed condition.

The patents described above are hereby expressly incorporated by reference in the description of the present invention.

In situations where the acceleration profile, over a preselected period of time, of a marine vessel is important in facilitating the launch procedure of a water skier, it would be significantly beneficial if a preferred acceleration profile could be learned by a control system of a marine vessel and then repeated upon demand to consistently accelerate that skier in a manner that is unchanged over a repeated number of launchings.

SUMMARY OF THE INVENTION

A method for controlling the acceleration of a marine vessel having an engine, in a preferred embodiment of the present invention, comprises the steps of receiving a plurality of speed related magnitudes associated with an operational parameter of the marine vessel and storing the plurality of speed related magnitudes of a water skier launch profile. The plurality of speed related magnitudes is received during the operation of the engine at a plurality of different speeds.

The plurality of speed related magnitudes can define the position of a manually movable throttle handle as a function of time. Alternatively, it can define the operating speed (e.g. RPM) of the engine as a function of time or the velocity (e.g. MPH) of the marine vessel as a function of time.

In a particularly preferred embodiment of the present invention, it further comprises the step of receiving a first signal which signifies the start of a calibration mode of operation. It can also comprise the step of receiving a second signal which initiates the step of receiving a plurality of speed related magnitudes. In a preferred embodiment of the present invention, it can further comprise the step of receiving a third signal which initiates the step of storing the plurality of speed related magnitudes as a water skier launch profile. The first signal can be initiated by a push button which is actuated by the operator of the marine vessel. This places the system on alert that the operator desires to perform a calibration, or learning process, whereby it receives and stores a water skier launch profile. The second signal can be a movement of a throttle handle from a stationary position to a different position, indicating that the operator of the marine vessel has begun to accelerate in order to launch a water skier. The third signal can be a push button that the operator of the marine vessel actuates after completing a successful launch so that the microprocessor, which has been used to perform various steps of the present invention, can store the profile for future use. This storage can include the identification of specific water skier launch profiles with names or numbers that are easily recognizable and which can be associated with a particular water skier. In a preferred embodiment of the present invention, the plurality of speed related magnitudes is received at a plurality of sequentially different speeds of the engine during a launch of a water skier.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
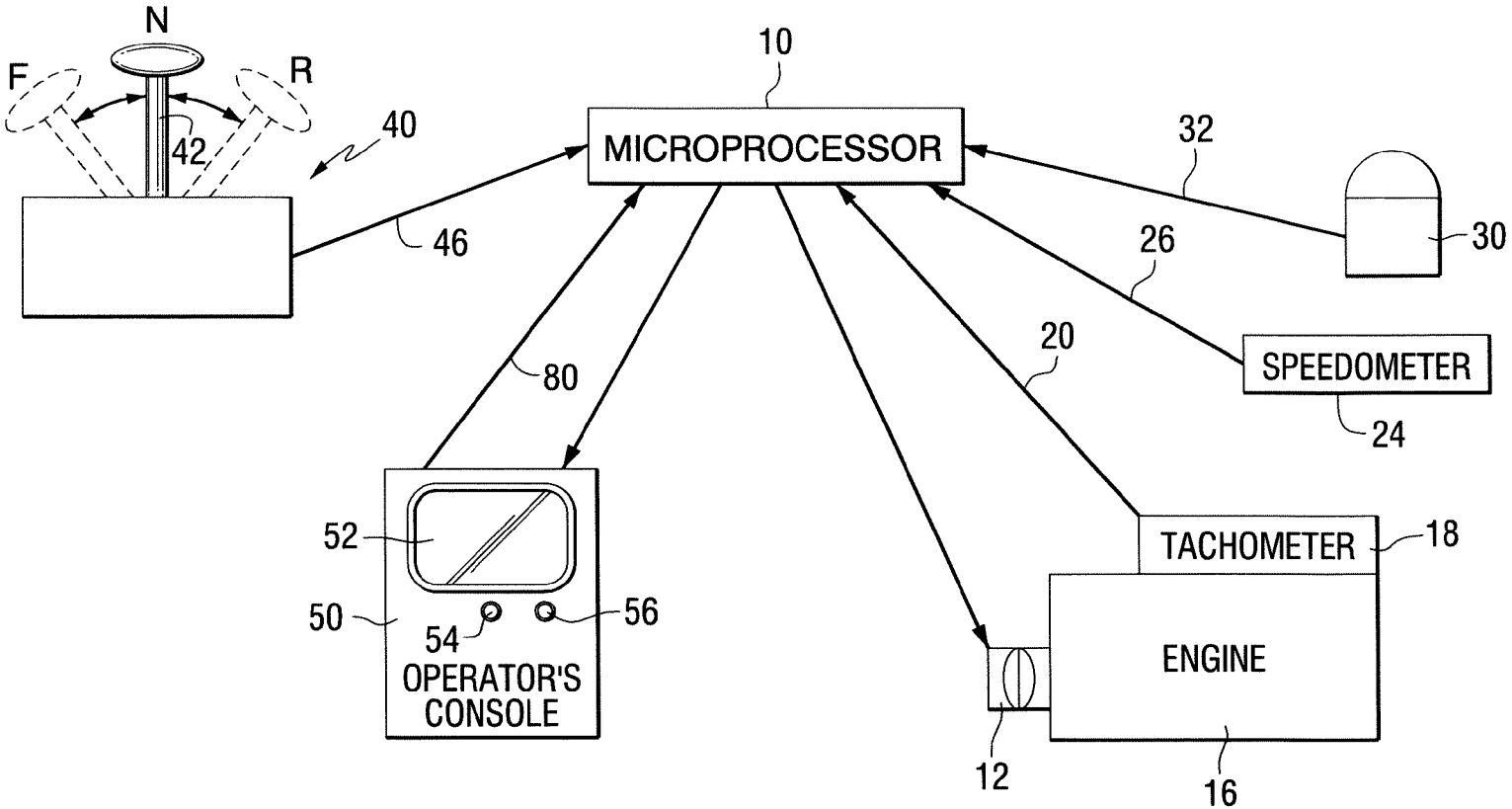
FIG. 1 is a schematic representation of a system used to perform the method of a preferred embodiment of the present invention.

Throughout the description of the preferred embodiment of the present invention, like components will be identified by like reference numerals.

FIG. 1 is a schematic representation of a system that can be used to perform the method of the present invention in a preferred embodiment. A microprocessor 10 is connected in signal communication with a throttle device 12 of an engine 16. A tachometer 18 provides signals, on line 20, representing the operating speed of the engine 16. Similarly, in various embodiments of the present invention, a speedometer 24 can provide signals on line 26 representing the velocity of the marine vessel. In addition, a GPS device 30 can be used to provide signals on line 32 relating to the velocity of the marine vessel. A manually manipulatable device 40, such as a throttle handle 42, is provided for the purpose of allowing the operator of a marine vessel to command various operational speeds of the engine 16. In certain types of digital throttle and shift (DTS) systems, signals are provided, on line 46, to the microprocessor 10 representing the position of the throttle handle 42. The handle 42 can be moved from a neutral N position into either forward F or reverse R positions as represented by the dashed line handles in FIG. 1. The position of the handle 42, usually relative to the neutral N or reverse R positions, is represented as a voltage signal on line 46 that has a magnitude which can be used to determine the percentage of maximum forward travel of the handle 42 or percentage of maximum reverse travel. Other systems may vary in the methodology used to transmit the handle position to the microprocessor 10, but the microprocessor is provided with sufficient information to determine the angular position of the handle 42 relative to a neutral position. This allows the microprocessor 10 to determine the demand, by the operator of the marine vessel, for engine speed. That demand magnitude is then converted to a command to the engine to achieve that operating speed. It should be recognized that the engine 16 can be a normally aspirated engine, an electronic fuel injected (EFI) engine, a direct fuel injected (DFI) engine or any other type of marine engine. In addition, the engine can be supercharged or turbocharged. The precise procedure used in causing the engine 16 to achieve the desired speed is not limiting to the present invention.

With continued reference to FIG. 1, an operator's console 50 can be provided to allow the operator of the marine vessel to communicate with the microprocessor 10. In addition to possibly providing a visual display 52, two push buttons, 54 and 56, are illustrated. These push buttons can provide signals to the microprocessor 10 which indicate a desire by the operator of the marine vessel to initiate a calibration mode, which will be described in greater detail below, and a signal which requests the microprocessor 10 to save data obtained during a calibration procedure.

Figure 2:
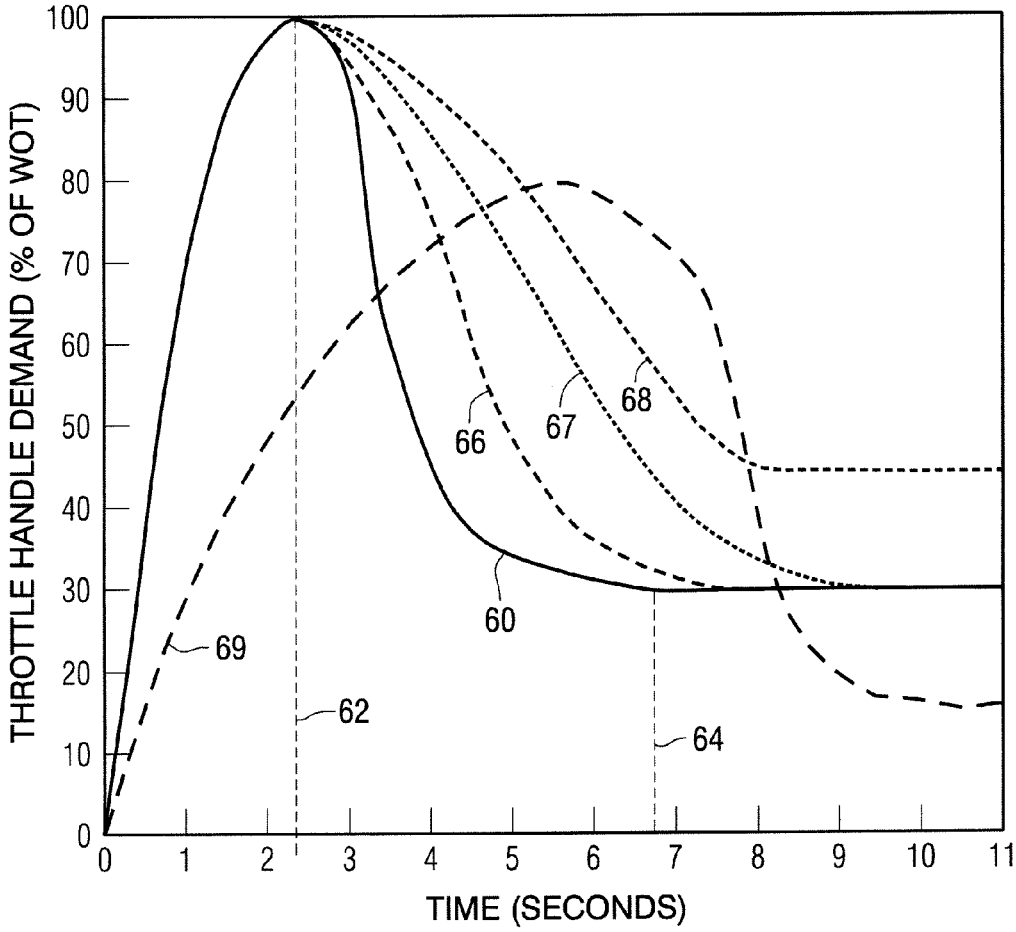
FIG. 2 is a graphical representation of numerous throttle movement profiles.

FIG. 2 is a graphical representation of the change of the position of the throttle handle 42, described above in conjunction with FIG. 1, over a period of time. The forward F position of the throttle handle is represented in FIG. 2 as a percentage of its maximum travel in a forward gear position. This is referred to as a percentage of wide open throttle (WOT).

In FIG. 2, the solid line curve 60 represents a hypothetical pattern of movement (i.e. a profile) of the throttle handle 42 described above in conjunction with FIG. 1. The signal on line 46 in FIG. 1 would be representative of the magnitude of line 60 in FIG. 2, either with an analog voltage magnitude being transmitted to the microprocessor 10 or, alternatively, by a plurality of digital values communicated between a microprocessor in the throttle handle device 40 and the microprocessor 10 shown in FIG. 1. Line 60 indicates that the throttle handle was rapidly moved from its neutral N position to the wide open throttle (WOT) position which is achieved at the time represented by dashed line 62. Then, beginning at dashed line 62, the throttle handle was moved back toward the neutral N position and, more specifically, to a position representing approximately 30% of a wide open throttle (WOT) command. That position of approximately 30% is achieved at the time represented by dashed line 64 in FIG. 2. It should be understood that, during the launch of a water skier from a stationary position to a skiing position, the operator of the marine vessel initially moves the throttle handle to a significantly forward position to cause the boat to move forward and upward from a stationary position to a position which is "on plane". As the boat initially moves from its stationary condition, significantly more engine speed is required as the propeller begins to move the boat forward and cause it to gain speed which is sufficient to rise upward to planing position. As the boat begins to move forward and rise toward a planing position, the operator of the marine vessel may pull back on the throttle from its maximum position in response to the behavior of the boat as it moves into its planing position. The precise magnitudes of the maximum handle position at dashed line 62 to the lesser position at dashed line 64 is hypothetical in FIG. 2 and is not intended to describe a required or limiting handle movement. Dashed lines 66-68 represent slight modifications to line 60 in which the handle is moved back toward the neutral position more slowly than represented by line 60. In addition, dashed line 68 represents a situation where the handle is not moved back to a 30% of full throttle position, but to a position slightly greater than 40%. It should be understood that these positions illustrated in FIG. 2 are not limiting to the present invention, but are provided as illustrative examples of various types is of movement of the handle 42 (i.e. different profiles), described above in conjunction with FIG. 1, during the launch of a water skier from a stationary to a skiing position. Dashed line 69 in FIG. 2 represents a situation in which the handle 42 is more slowly moved away from the neutral N position and does not achieve a wide open throttle (WOT) position of 100%. Instead, it achieves a throttle handle position of approximately 80% and then the operator of the marine vessel begins to back away from this position, toward the neutral N position, and eventually returns the handle to a position slightly greater than 15%. All of the lines in FIG. 2 represent exemplary throttle handle movements that could possibly occur during the launch of a water skier.

With continued reference to FIGS. 1 and 2, it should be understood that the actual speed of the engine 16, in RPM, does not track precisely with the movement of the throttle handle 42. A natural lag, or delay, exists between the initial movement of the handle 42 by the operator and the response of the engine. In addition, a further delay occurs between the increase in engine speed and the corresponding increase in velocity of the boat.

Figure 3:
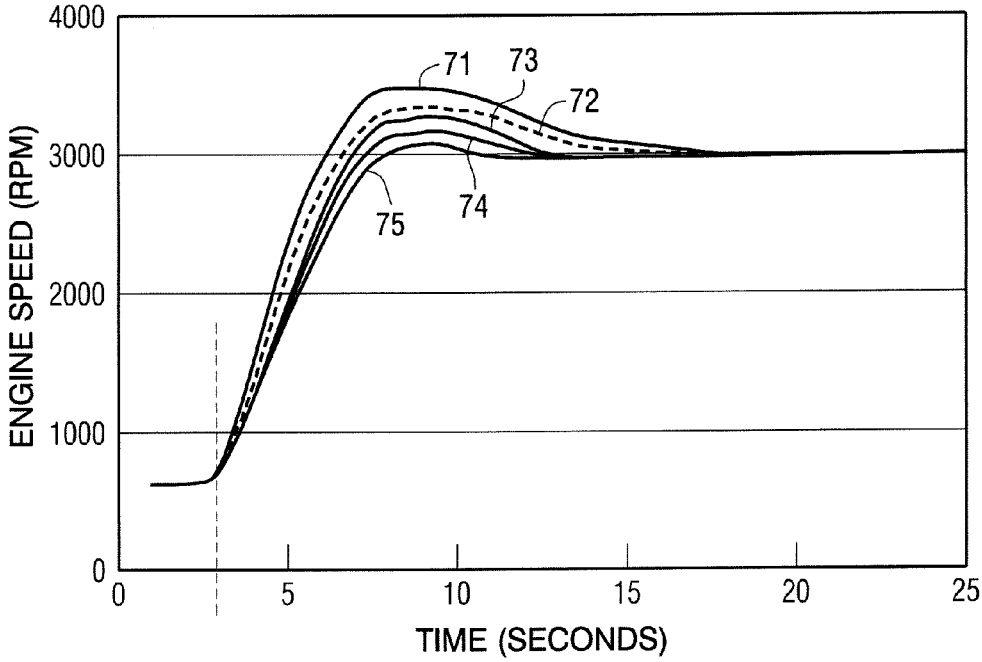
FIG. 3 is a graphical representation of numerous engine speed profiles.

FIG. 3 illustrates numerous engine speed profiles that can be used to launch a water skier. The creation of the profiles shown in FIG. 3 is described in significant detail in U.S. patent application Ser. No. 11/245,370. The manner in which the speed of the engine is controlled to achieve the various acceleration profiles shown in FIG. 3 is not limiting to the present invention, but is illustrative of the general shape and configuration of the engine speed profiles. The acceleration profiles 71-75 represent various launching patterns that can be entered into a microprocessor memory and recalled when needed. The profiles described in the patent application Ser. No. 11/245,370 are not created through the actual experimental launching of a water skier during a calibration procedure but, instead, are pre-established and later used by water skiers.

The intent of the method of the present invention is to allow a custom acceleration profile to be created empirically, while actually launching a water skier, and then stored for further use by that water skier. The launch profile is received and stored as the water skier is actually experiencing the launch procedure. Throughout this patent application, this process is referred to as a calibration process and can comprise several trial and error launches until the water skier feels that the acceleration profile of the boat is optimized for future use.

Although the present invention could monitor the actual speed of the engine during the launch process and recreate that acceleration profile, in a preferred embodiment of the present invention the throttle handle position is monitored, received, and stored. When the launch is to be recreated, the control system of the marine propulsion device recreates the engine speed profile as it would if the handle was actually being moved manually by the operator of the marine vessel to its various positions. However, after providing a start signal, the operator of the marine vessel need not manually control the acceleration of the boat. Instead, when placed in the proper mode, the present invention will provide commands to the engine that are the same as it would if the handle was actually being moved according to the pattern, or profile, stored during the calibration procedure.

With continued reference to FIGS. 1-3, it is intended that the operator of the marine vessel first place the microprocessor 10 in a calibration mode by pressing a button 54 that provides a signal, on line 80, which alerts the microprocessor 10 that the next launch process will be a calibration (i.e. learning) maneuver that should be received and stored. Then, in a preferred embodiment of the present invention, the operator of the marine vessel begins to move the throttle handle 42 to accelerate the boat and launch the water skier. Since the microprocessor 10 has been alerted, by the pushing of button 54, that it is in a calibration mode, the subsequent movement of the handle 42 is monitored and signals on line 46 are stored at a preselected frequency to create a database representing the water skier launch profile. In that way, the stored data can later be used to precisely simulate that actual movement of the throttle handle 42 without the need for the operator to actually repeat that pattern of handle movement. If the water skier launch profile is acceptable after having pulled the water skier from a stationary position to a skiing position, push button 56 can be activated to cause the microprocessor 10 to save the data. In certain embodiments of the present invention, the stored data can be saved with an identification, such as the water skier's name, that allows easy retrieval for future launches. It should be understood that in alternative embodiments of the present invention, the placing of the system in a calibration mode can be accomplished through a keyboard entry rather than by pushing a button. In addition, each calibration procedure could be automatically saved without intervention by the operator of the marine vessel and undesirable launch profiles could later require deletion. These are optional processes and not limiting to the present invention.

With continued reference to FIGS. 1-3, a saved launch profile can be recalled by the operator of the marine vessel and activated to accelerate the marine vessel according to the launch profile. This can be done in several ways. The display 52 and keyboard entries can initiate the recall process. In addition, the push buttons, 54 and 56, can be actuated to accomplish this task. The actual initiation of the recalled launch profile, whereby the boat is accelerated according to the profile, can be started by the operator pushing a button or, as in a preferred embodiment of the present invention, by the operator actually moving the throttle handle 42 in a forward direction toward the wide open throttle (WOT) position. In certain embodiments of the present invention, any forward movement of the throttle handle 42, after the system has been armed to recall and repeat a launch profile, can be used to trigger the initiation of the procedure. These are optional variations of a preferred embodiment of the present invention.

Figure 4:
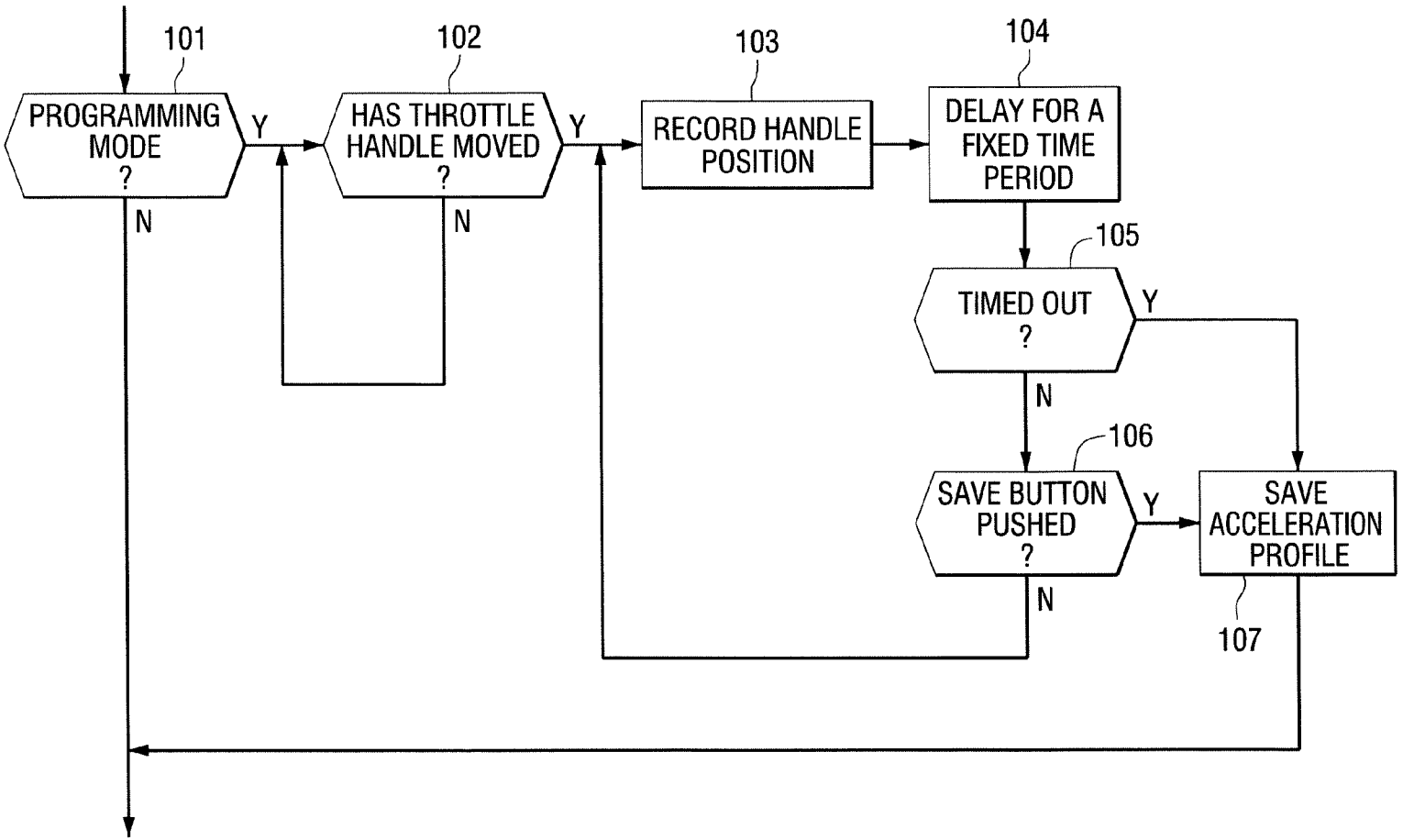
FIG. 4 is a simplified flowchart showing a program segment relating to a calibration procedure of the present invention.

FIG. 4 is a simplified flowchart segment showing how the present invention can be implemented by software in the microprocessor 10. At functional block 101, the computer determines whether or not it is in the programming or calibration mode. If it is not in the programming or calibration mode, it simply proceeds with other tasks. If it is in the calibration or programming mode, it determines if the throttle handle 42 has been moved. This is done at functional block 102. If it has not moved, it continues to watch the signal on line 42 to determine the initiation of movement. When the handle has moved, its position is recorded at functional block 103, a time delay is executed at functional block 104 and then, after determining whether or not the procedures has timed out at functional block 105 or the save push button has been pushed at functional block 106, the process is repeated by recording a subsequent handle position at functional block 103 and again executing a delay at functional block 104. In a particularly preferred embodiment of the present invention, the time delay at functional block 104 is approximately 50 milliseconds. That means that each received handle position represents the position of the handle 42 at increments of time generally equal to 50 milliseconds. This stores approximately 20 magnitudes per second. In ten seconds, which is the approximate time needed to store a launch profile, 200 values will be stored. At functional block 105, an upper limit is set to discontinue the process after a certain elapsed period of time even if the save button 106 is not actuated. This maximum period of time could be approximately 10 to 15 seconds. Naturally, the present invention can also be performed with other magnitudes of time delay at functional block 104. Larger time delays between sequential data points will reduce the overall storage requirement for each of the launch profiles.

With continued reference to FIG. 4, when the save button is detected at functional block 106, the acceleration profile is saved at functional block 107. As the data is saved, the program would also perform various housekeeping chores, such as taking itself out of the calibration or programming mode. The save feature at functional block 107 would also typically ask for an identifier under which to store the launch profile.

Figure 5:
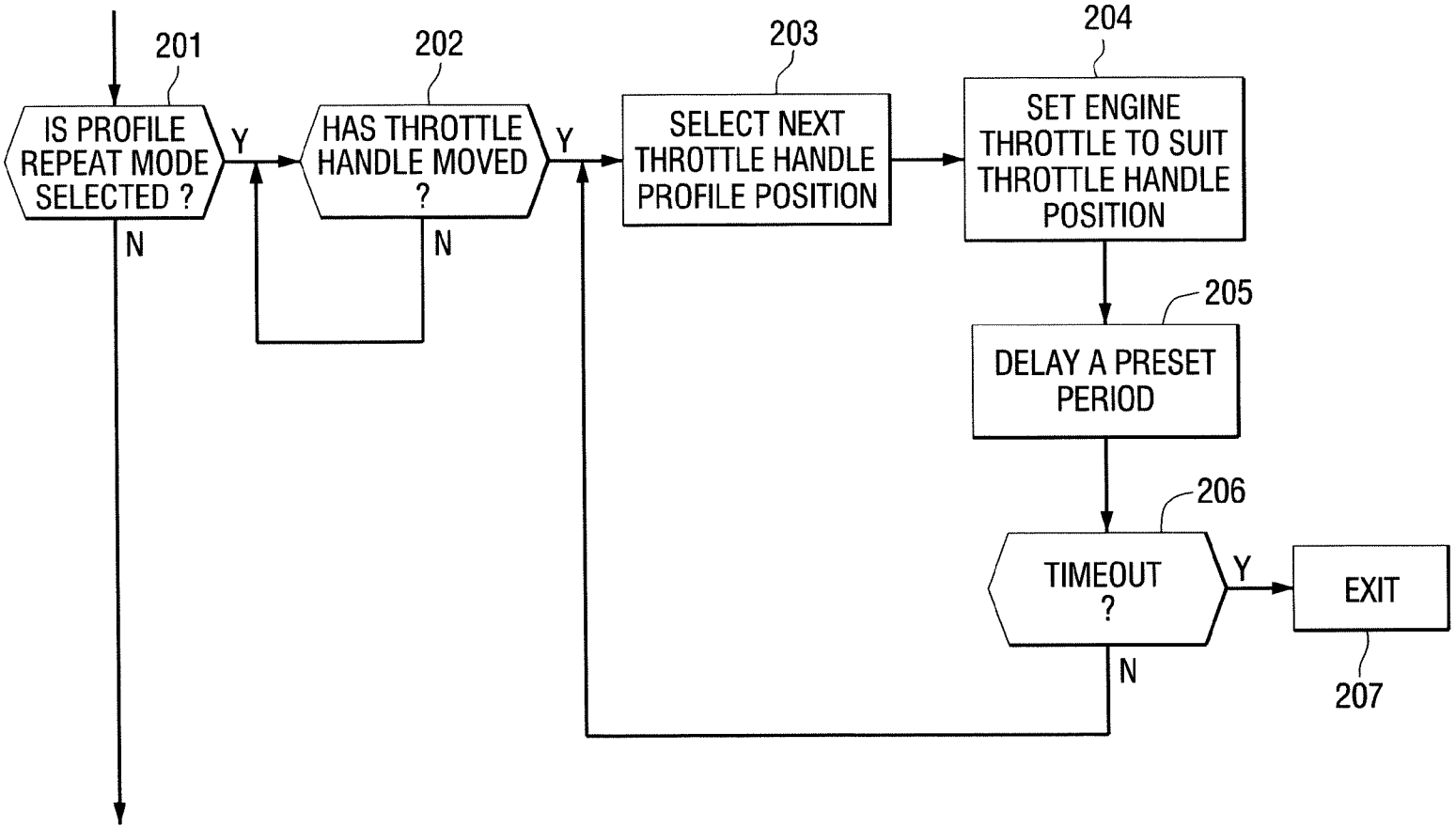
FIG. 5 is a simplified flowchart showing a portion of a program used to recall and repeat a launch profile stored by a preferred embodiment of the present invention.

FIG. 5 illustrates a simplified process under which a stored launch profile can be repeated or executed. At functional block 201, the program determines if the profile repeat mode has been selected. This would be accomplished by the operator of the marine vessel selecting an identified launch profile that was previously stored following a calibration process as described above. If the profile repeat mode is selected, the microprocessor watches the throttle handle 42 to determine whether or not it has been moved toward a wide open throttle (WOT) position or, alternatively, away from a neutral N position. If it has not, the microprocessor will continue to monitor the throttle handle position. If it has been moved, the microprocessor selects the next throttle position point that has been stored as part of the profile for this particular water skier at functional block 203 and the engine is controlled to that stored throttle handle position at functional block 204. Then the microprocessor delays for a preselected time period at functional block 205. That time period would typically be equal to the time period used in functional block 104 in FIG. 4. If a time out occurs at functional block 206, the system is caused to maintain the current engine speed of the boat. This presumes that the water skier has achieved a planing position. If at any time, the operator of the marine vessel pulls back on the throttle handle from its current position, the program would be deactivated and control of the throttle would be returned to the operator of the marine vessel. This could possibly occur if the water skier fell. The exit is at functional block 207.

Some vessel control systems incorporate a throttle limiter that assures that the actual position of the engine throttle plate is not moved beyond a position that is in accord with the actual physical position of the manually operated throttle handle. As a result, the engine control module computer may limit the movement of the throttle plate of the engine if the throttle handle has not moved beyond a physical position that would normally command the throttle plate to move to that position. Therefore, certain embodiments of the present invention may require that the operator of the marine vessel quickly move the handle from the neutral position to the wide open throttle position so that the movement of the throttle plate, in accordance with the stored profile, is not inhibited because of the physical position of the throttle handle. Alternatively, certain embodiments of the present invention could turn off the throttle limiter during the replay of a stored profile. It should be understood that the particular process used in conjunction with the presence or absence of a throttle limiter is not limiting to the present invention.

Those skilled in the art of marine propulsion systems and water skiing procedures will recognize that the present invention uses an actual water skier launch to empirically determine a preferred launch profile. As an operator of a marine vessel actually manipulates the handle to achieve a satisfactory launch of the water skier from a stationary to a skiing position, a microprocessor continuously monitors the position of the handle. This is done while the handle is being moved and a plurality of sequentially different speeds is being achieved by the engine during the actual launch of a water skier. The process of the present invention requires no theoretical determinations of launch acceleration profiles. Instead, it calibrates a launch profile during an actual successful launch and stores that information so that it can be repeated numerous times to precisely repeat the successful launch profile.

Although the present invention has been described with particular detail and illustrated to show a preferred embodiment, it should be understood that alternative embodiments are also within its scope.

I claim:

1. A method for controlling the acceleration of a marine vessel having an engine, comprising the steps of:

receiving a plurality of speed related magnitudes associated with an operational parameter of said marine vessel, said plurality of speed related magnitudes being received during the operation of said engine at a plurality of different speeds, said receiving step being performed during an actual launch of a water skier; and storing said plurality of speed related magnitudes as an empirically derived water skier launch profile for repetition during a subsequent launch said water skier launch profile comprising said plurality of speed related magnitudes stored as a function of time.

2. The method of claim 1, wherein:

said plurality of speed related magnitudes is received at a plurality of sequentially different speeds of said engine during a launch of a water skier.

3. The method of claim 1, wherein:

said plurality of speed related magnitudes define the position of a manually movable throttle handle as a function of time.

4. The method of claim 1, wherein:

said plurality of speed related magnitudes define the operating speed of said engine as a function of time.

5. The method of claim 1, further comprising:

receiving a first signal which signifies the start of a calibration mode of operation.

6. The method of claim 5, further comprising:

receiving a second signal which initiates said step of receiving a plurality of speed related magnitudes.

7. The method of claim 6, further comprising:

receiving a third signal which initiates said step of storing said plurality of speed related magnitudes as said water skier launch profile.

8. The method of claim 1, further comprising:

receiving a start signal;

selecting said water skier launch profile;

controlling the operating speed of said engine according to said water skier launch profile.

9. The method of claim 1, wherein:

each of said plurality of speed related magnitudes is separated from at least one other of said plurality of speed related magnitudes by an interstice which is generally equal to a first time interval.

10. A method for controlling the acceleration of a marine vessel having an engine, comprising the steps of:

receiving a calibration signal which signifies the start of a calibration mode of operation;

receiving an initiation signal;

receiving a plurality of speed related magnitudes associated with an operational parameter of said marine vessel, said plurality of speed related magnitudes being received during the operation of said engine at a plurality of different speeds, said plurality of speed related magnitudes being received at a plurality of sequentially different speeds of said engine during a launch of a water skier, said receiving step being performed during an actual launch of a water skier;

receiving a save signal; and storing said plurality of speed related magnitudes as an empirically derived water skier launch profile for repetition during a subsequent launch, said water skier launch profile comprising said plurality of speed related magnitudes stored as a function of time.

11. The method of claim 10, further comprising:

receiving a start signal;

selecting said water skier launch profile;

controlling the operating speed of said engine according to said water skier launch profile.

12. The method of claim 11, wherein:

said plurality of speed related magnitudes define the position of a manually movable throttle handle as a function of time.

13. The method of claim 11, wherein:

said plurality of speed related magnitudes define the operating speed of said engine as a function of time.

14. The method of claim 11, wherein:

said plurality of speed related magnitudes define the velocity of said marine vessel as a function of time.

15. The method of claim 10, wherein:

each of said plurality of speed related magnitudes is separated from at least one other of said plurality of speed related magnitudes by an interstice which is generally equal to a first time interval.

16. A method for controlling the acceleration of a marine vessel having an engine, comprising the steps of:

receiving a calibration signal which signifies the start of a calibration mode of operation;

receiving an initiation signal;

receiving a plurality of speed related magnitudes associated with an operational parameter of said marine vessel in response to said initiation signal, said plurality of speed related magnitudes being received during the operation of said engine at a plurality of different speeds, said receiving step being performed during an actual launch of a water skier, said plurality of speed related magnitudes being received at a plurality of sequentially different speeds of said engine during a launch of a water skier;

receiving a save signal;

storing said plurality of speed related magnitudes as an empirically derived water skier launch profile for repetition during a subsequent launch said water skier launch profile comprising said plurality of speed related magnitudes stored as a function of time, in response to said save signal;

receiving a start signal;

selecting said water skier launch profile;

controlling the operating speed of said engine according to said water skier launch profile.

17. The method of claim 16, wherein:

said plurality of speed related magnitudes define the position of a manually movable throttle handle as a function of time.

18. The method of claim 17, wherein:

each of said plurality of speed related magnitudes is separated from at least one other of said plurality of speed related magnitudes by an interstice which is generally equal to a first time interval.

19. The method of claim 16, wherein:

said initiation signal is a movement of a throttle handle subsequent to receipt of said calibration signal.

20. The method of claim 19, wherein:

said start signal is a movement of a throttle handle by greater than a preselected magnitude.

* * * * *